US005207628A

United States Patent [19]

Graham

[11] Patent Number: 5,207,628

[45] Date of Patent: May 4, 1993

[54] SUSPENDING FOLD-AWAY BED EXERCISING DEVICE

[76] Inventor: Otha O. Graham, 111 Maine St., P.O. Box 386, Maysville, N.C. 28555

[21] Appl. No.: 793,624

[22] Filed: Nov. 18, 1991

[51] Int. Cl.[5] ..... A63B 26/00

[52] U.S. Cl. ..... 482/140; 482/904

[58] Field of Search ..... 482/23, 140, 142, 143, 482/144, 145, 907, 904

[56] References Cited

U.S. PATENT DOCUMENTS

| | | | |
|---|---|---|---|
| 1,705,745 | 9/1929 | Anderson . | |
| 3,134,592 | 3/1944 | Sharkey | 272/58 |
| 3,787,048 | 12/1974 | Bock . | |
| 3,826,490 | 7/1974 | Mossman | 482/904 |
| 4,398,713 | 8/1983 | Ellis | 482/145 |
| 4,422,635 | 6/1983 | Herod | 272/96 |
| 4,515,361 | 7/1985 | Melillo | 272/93 |

FOREIGN PATENT DOCUMENTS

WO8803825 6/1988 World Int. Prop. O. .

*Primary Examiner*—Stephen R. Crow

[57] ABSTRACT

A device is disclosed which may be used by a person for exercising in bed. The device includes in a preferred embodiment a flat rectangular base plate [101] which is attached to the under side of a bed with three clamps [108] and [110]. Support rings [126] are attached to the under side of the base [101]. A telescoping adjustable U shaped bar [130–205] is inserted through the rings [126] and extends upwardly and over the bed. The lower prong of the bar which is passed through the rings is slightly more than two times the length of the prong which extends over the bed. Adjustable cushions for the feet [217]–[216] are attached to upper prong of the bar suspending over the bed. The bar is allowed to pivot via rings [126]. A cord assembly [236]–[238] is attached to top of the prong over the bed enabling a person to use this unit in the process of doing various exercises including sit-up and pull-up motions. The device folds under bed out of sight when not in use, no tools are needed to fold, adjust, attach, or detach the device.

11 Claims, 9 Drawing Sheets

140
121
120
106
144
99
126
143
130
136
138
145
101
100
142
141
128
5
119
134
102
108
118
132
122
7
8

FIG. 10
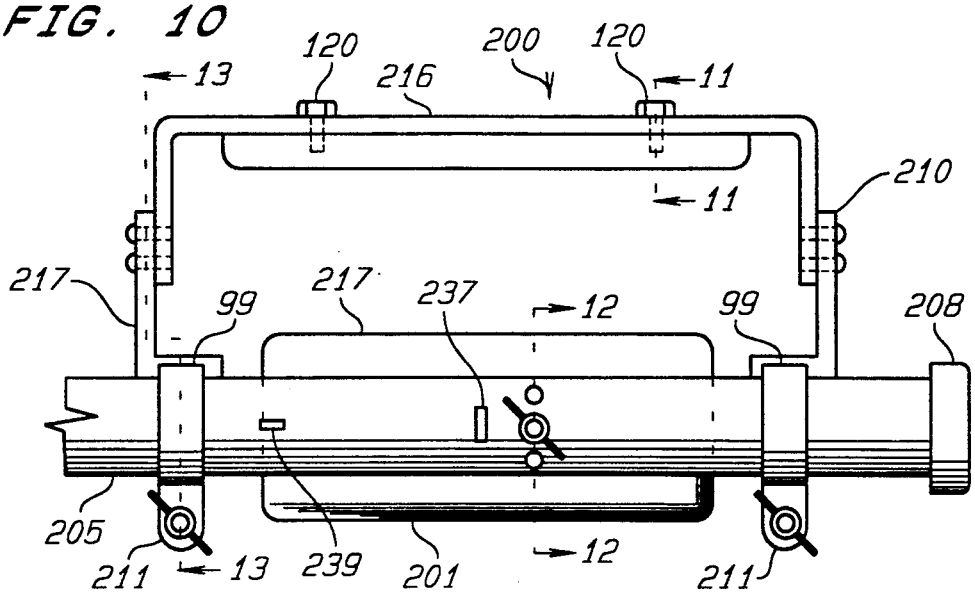
FIG. 12
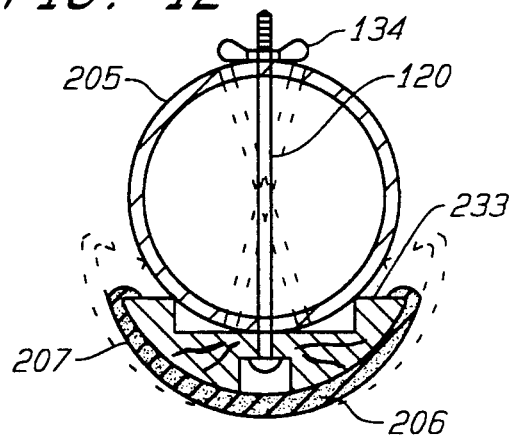
FIG. 11
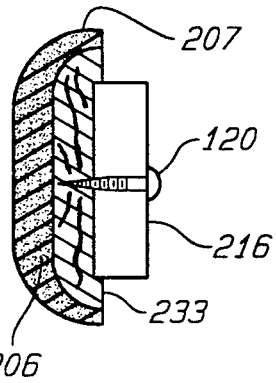
FIG. 14
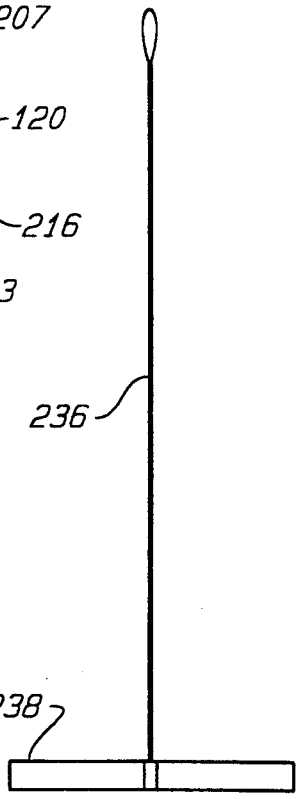
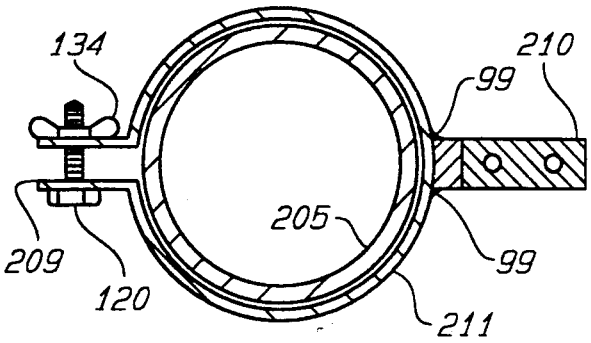
FIG. 13

FIG. 15a
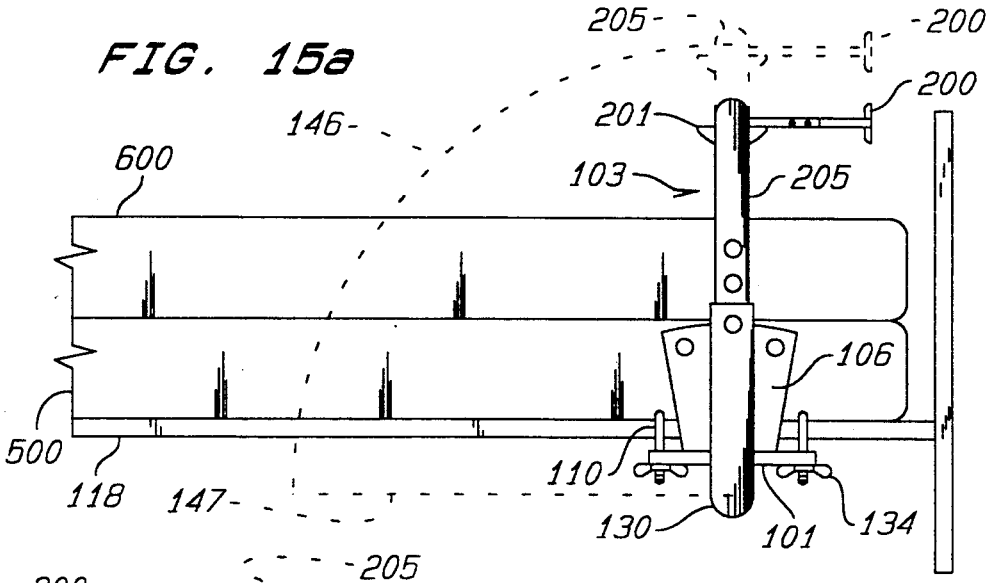
FIG. 15b
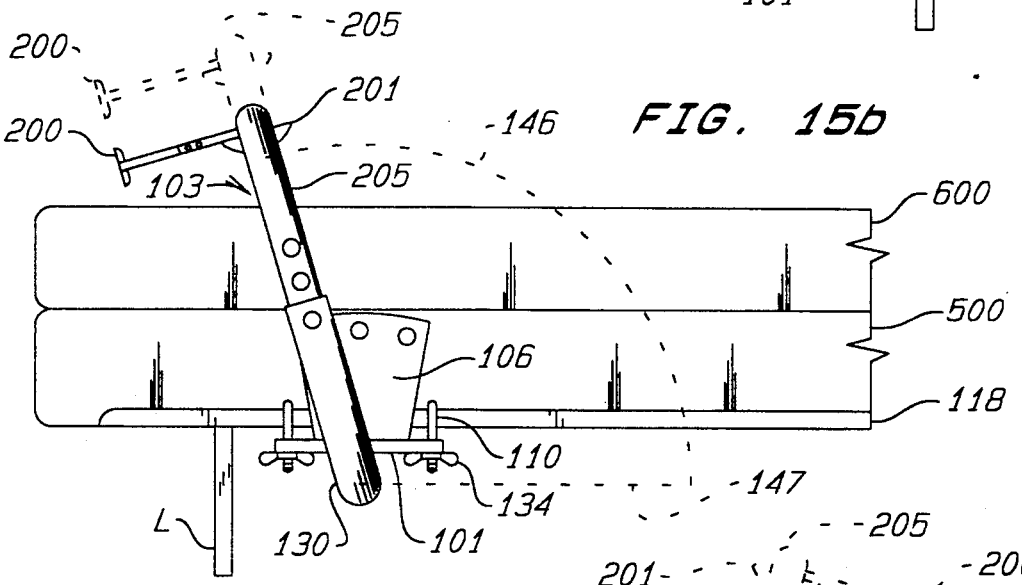
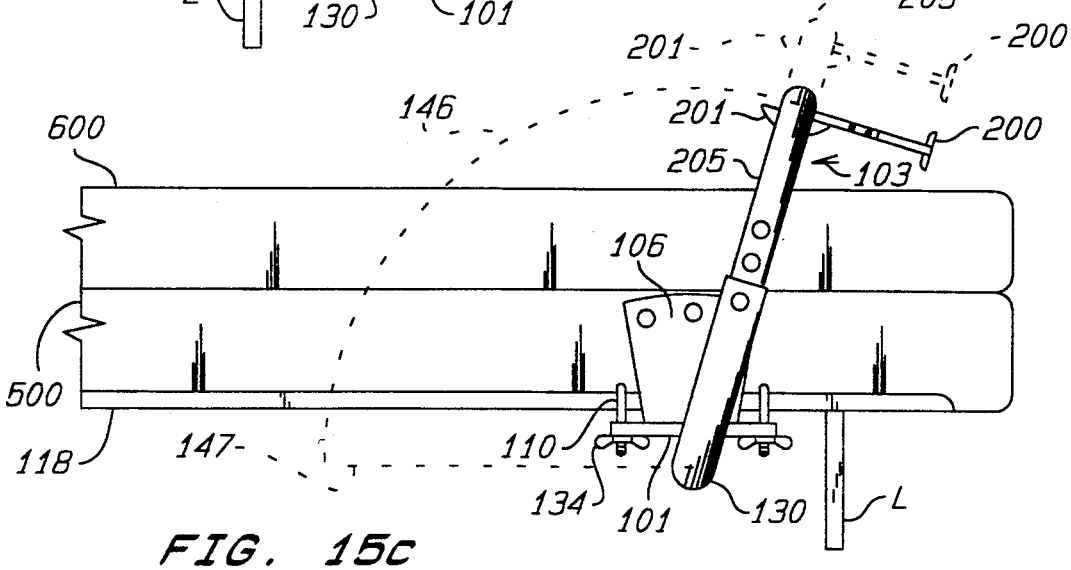
FIG. 15c 10
208
205a
120
237
239
210
210
201
205
103
205b
600
B
500
102
120
132
118
104
125
116
120
122
126
101
130
128
126
110

208
201
210
120
124
237
239
210
305a
305b
305a
305b
306
307
306
307
305a
305b
306a
306
307
305
301
302
118
131
133
306
306a
307
305b
128
126
130
101
128
126
130

SUSPENDING FOLD-AWAY BED EXERCISING DEVICE

BACKGROUND OF THE INVENTION

1. Field of the Invention

This invention relates to exercising devices and more specifically to exercising devices which are used for exercising in bed.

2. Description of the Prior Art

Heretofore bed exercising devices were cumbersome and inconvenient in that one or more were limited to one type of bed, unbecoming to the bed room, required excessive effort to remove or store out of sight, of such structure that they had to be removed from the bed in order to change linen, useable only on beds having high footboards and difficult to use on beds with high footboards.

Patents representative of the prior art showing exercising devices for use in beds are: U.S. Pat. No. 3,134,592 to R. V. Sharkey issued May 26, 1946 and U.S. Pat. No. 4,515,361 to Melillo and Gabriele issued May 7, 1985. The exercising device disclosed in U.S. Pat. No. 3,134,592 can be used only on beds having high footboards. The exercising device disclosed in U.S. Pat. No. 4,515,361 would have to be removed from the bed while changing linen or making-up the bed. Also since it fits between the mattress and the footboard there would be insufficient room for a person's feet when the device is being used on a bed having a high footboard.

Most people, especially women, are sensitive about the appearance of their beds when not in use, therefore, exercising devices sitting in full view while not being used would be objectionable to these persons. One would probably soon get tired of lifting these devices off and out of the bed and having to go through the same chore each time the exercising device is used. This would not offer much incentive to exercise.

In the past inventors in the exercise device field have directed their attention primarily to bulky, somewhat expensive products mostly suitable to gym rooms etc., without much thought to limited income, limited time, limited space, increasing numbers of women and senior citizens getting into the art of exercising for better health and enjoyment of living.

In the case of elderly and over weight persons there is a need for some way they can assist their back and hip muscles in the case of sit-up exercise which is the prevailing type of bed exercising. Many of these persons cannot start off doing sit-ups without some help from their arms either pushing up or pulling forward.

OBJECTS AND ADVANTAGES

It is an object of this invention to provide an exercising device which can be used on almost and type of bed.

It is a further object to provide an exercising device which can be upholstered and finished to match the decor of the bedroom or bed.

It is another object to provide an exercising device which can be easily changed from a use position to a stored position out of sight without the use of tools and without lifting.

It is another object to provide an exercising device that does not interfere with changing bed linen and does not have to be removed when making up the bed.

It is another object to provide an exercising device which is equally used on almost any bed with or without footboards.

It is another object to provide an exercising device that is easily used by persons of almost any age.

It is another object to provide an exercising device which can be manufactured from material easily available in the market place.

It is another object to provide an exercising device in which both the hands and arms can be used in combination with the back and hip muscles in the process of sit-up exercise.

It is another object to provide an exercise device which can be used even under the bed covering.

Further objects and advantages of my invention will become apparent from consideration of the accompanying drawings and description. In the drawings like characters of reference are used to designate like parts.

BRIEF DESCRIPTION OF THE DRAWINGS

FIG. 10 is a fragmentary top plan view as would be seen looking down upon the components shown in FIG. 1.

FIG. 11 is a sectional view taken on the plane shown by section line 11—11 of FIG. 10;

FIG. 12 is a sectional view taken on the plane shown by section line 12—12 of FIG. 10:

FIG. 13 is a sectional view taken along line 13—13 of FIG. 10:

FIG. 14 is a plan view of the pull cord and handle portion of the invention;

FIGS. 15*a*, 15*b* and 15*c* are side elevational views of the invention mounted in different positions to accommodate different styles of beds;

FIG. 15*a* shows the invention mounted on a bed with a footboard;

FIG. 15*b* shows the invention mounted on a hollywood style bed forward of the rear leg L;

FIG. 15*c* shows the invention mounted on a hollywood style bed as in FIG. 15*b* but on the opposite side of the bed from the position of the invention shown in FIG. 15*b;*

DESCRIPTION OF THE PREFERRED EMBODIMENT

Figures 2, 7, 8:
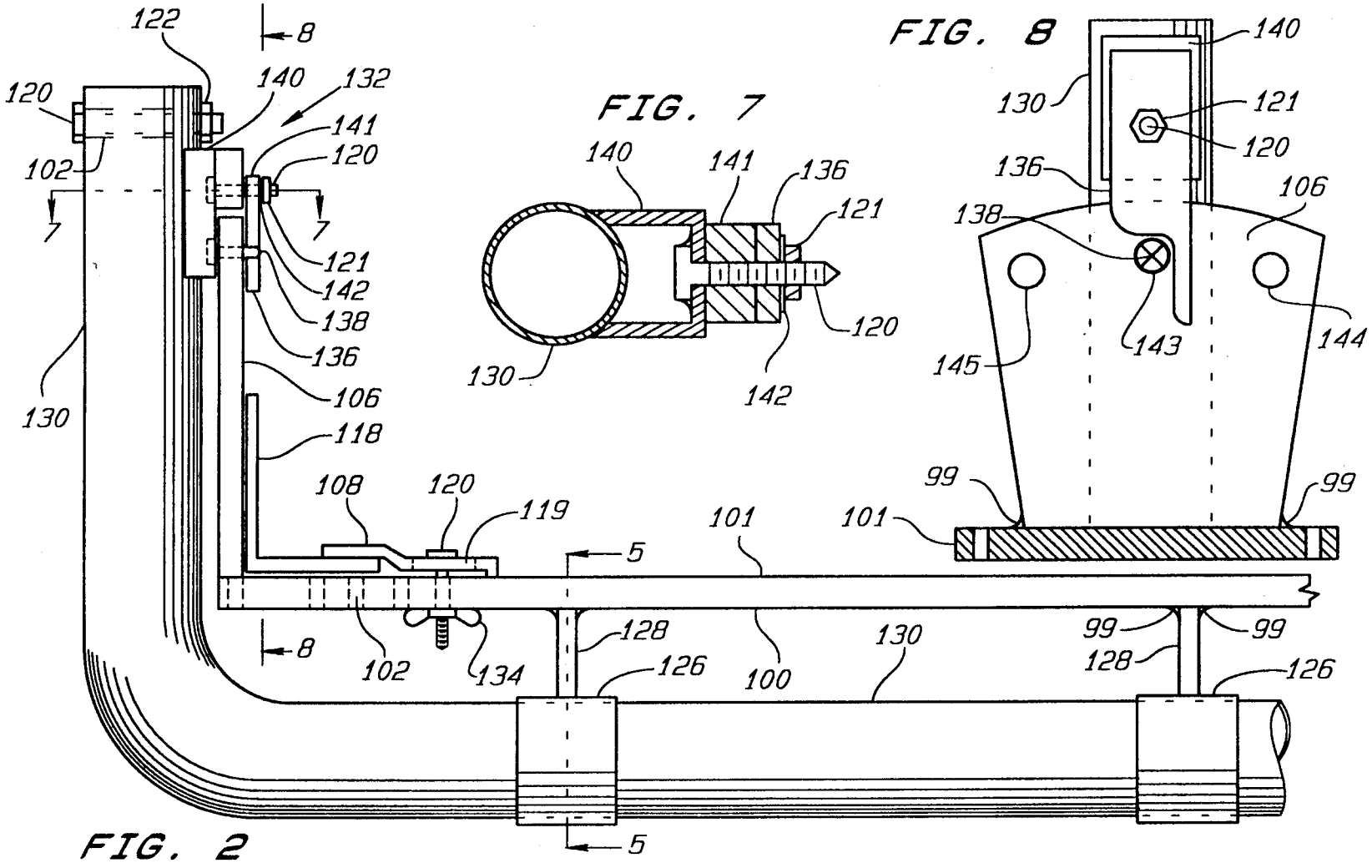
FIG. 2 is a fragmentary elevational view showing the lower portion of the support bracket with its right end broken away and the base plate assembly clamped to a bed rail.
FIG. 7 is a sectional view taken upon the plane indicated by the section line 7—7 of FIG. 2.
FIG. 8 is sectional view taken upon the plane indicated by the section line 8—8 of FIG. 2 omitting the bed rail 118.
Figure 5:
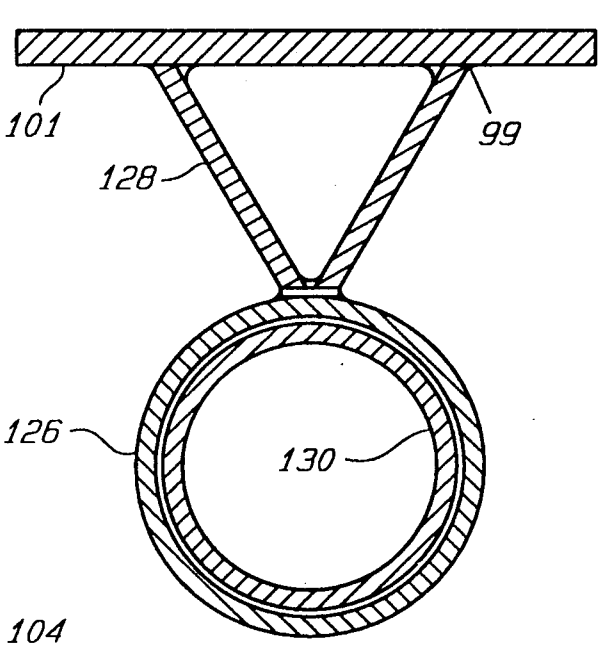
FIG. 5 is a sectional view taken upon the plane indicated by the section line 5—5 of FIG. 2.

Referring to the drawings one embodiment 10 of the invention is illustrated in FIGS. 1–17. FIG. 7 shows the invention 10 installed on a bed B in position for use while FIG. 16 shows a person P lying face up on the bed demonstrating the invention's intended use by the person for performing sit-ups while in bed.

Figure 16:
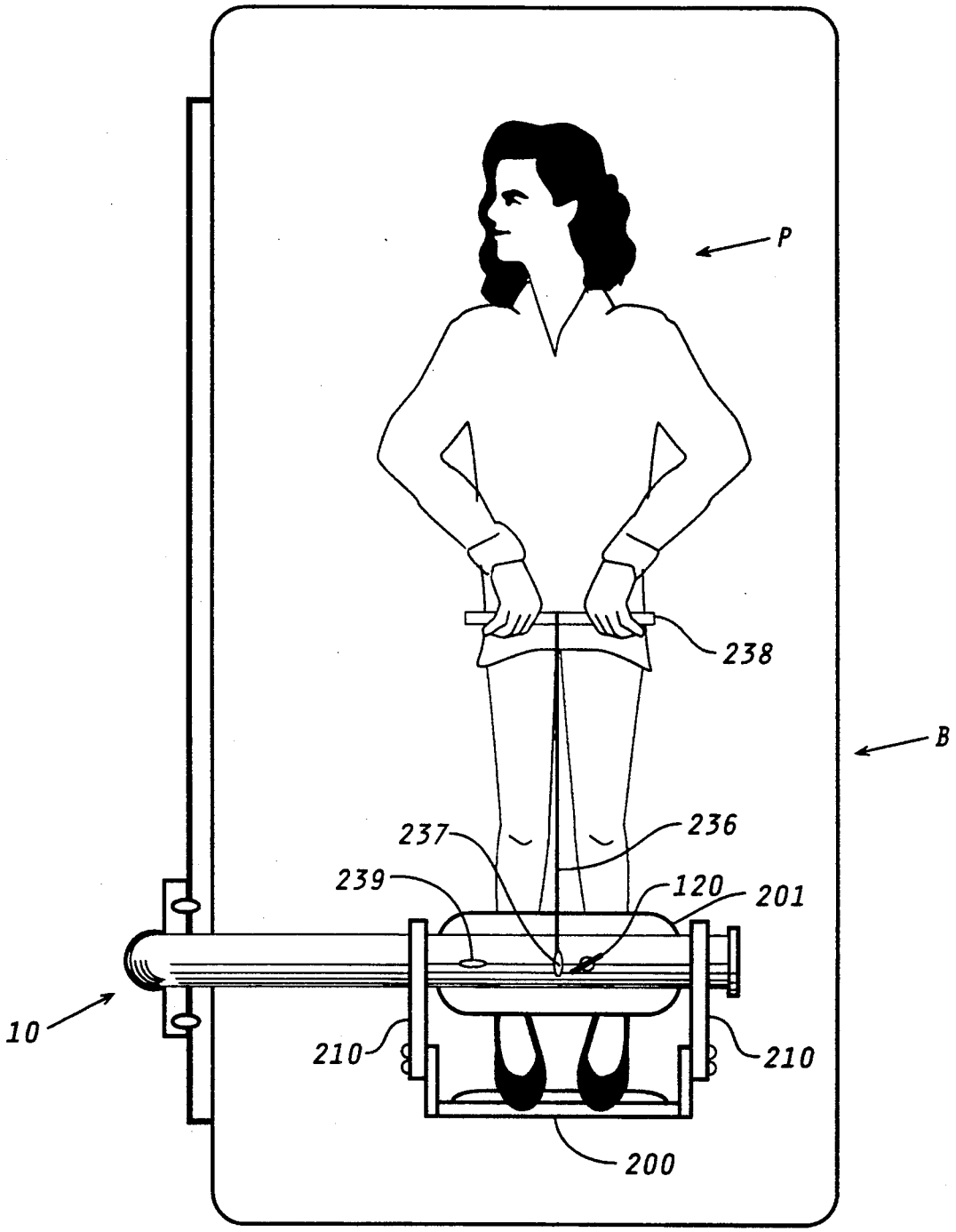
FIG. 16 is a top plan view of the invention mounted on the side of a bed and showing the invention is use.
Figure 17:
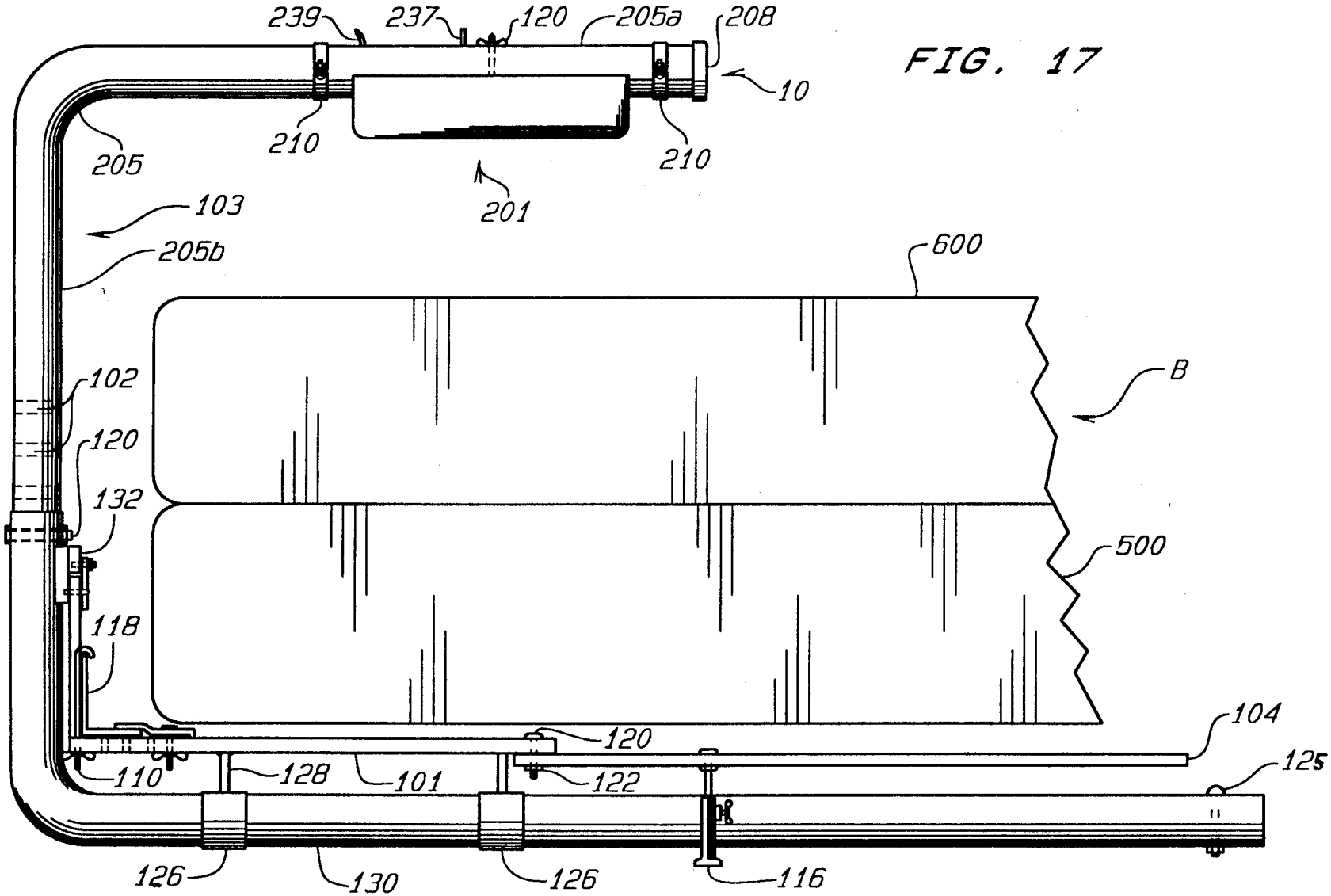
FIG. 17 is an elevational view of the invention assembled and mounted on one side of a bed.

The invention 10 as seen in FIG. 17 comprises a base assembly 100 clamped to a bed side rail 118, a U-shaped tubular suspension bracket 103 rotatably and slidably supported by the base assembly 100, a foot support bar assembly 200 (see FIG. 16) suspended above the bed by the U-shaped suspension bracket 103 and an instep support assembly 201 also mounted on the bracket 103. A pull cord 236 is attached at one end to a cord ring 237 on the bracket 103 and to a grip bar, or handle 238, at its other end.

In using the invention as seen in FIG. 16 the person lying on top of the bed mattress 600 slides along the mattress until the person's feet can be raised and engaged with the foot support bar assembly 200. The support bar assembly 200 is rotatable on the bracket 103 under pressure from the person's feet engaged therewith from a normal vertically suspended position under the suspension bar 205 of the bracket 103 to a position extended away from the person P. The person's foot insteps engage under the cushioned instep support assembly 201. With the feet restrained as shown in FIG. 16, a person trained in performing sit-ups can lift the body upwardly about the hips which remain on the surface of the mattress. A person just beginning to do sit-ups will often need the assist of the pull cord 236 to help lift the body upwardly to a sitting position. As is well known the sit-up exercises are useful in developing a person's stomach muscles.

Figures 1, 9:
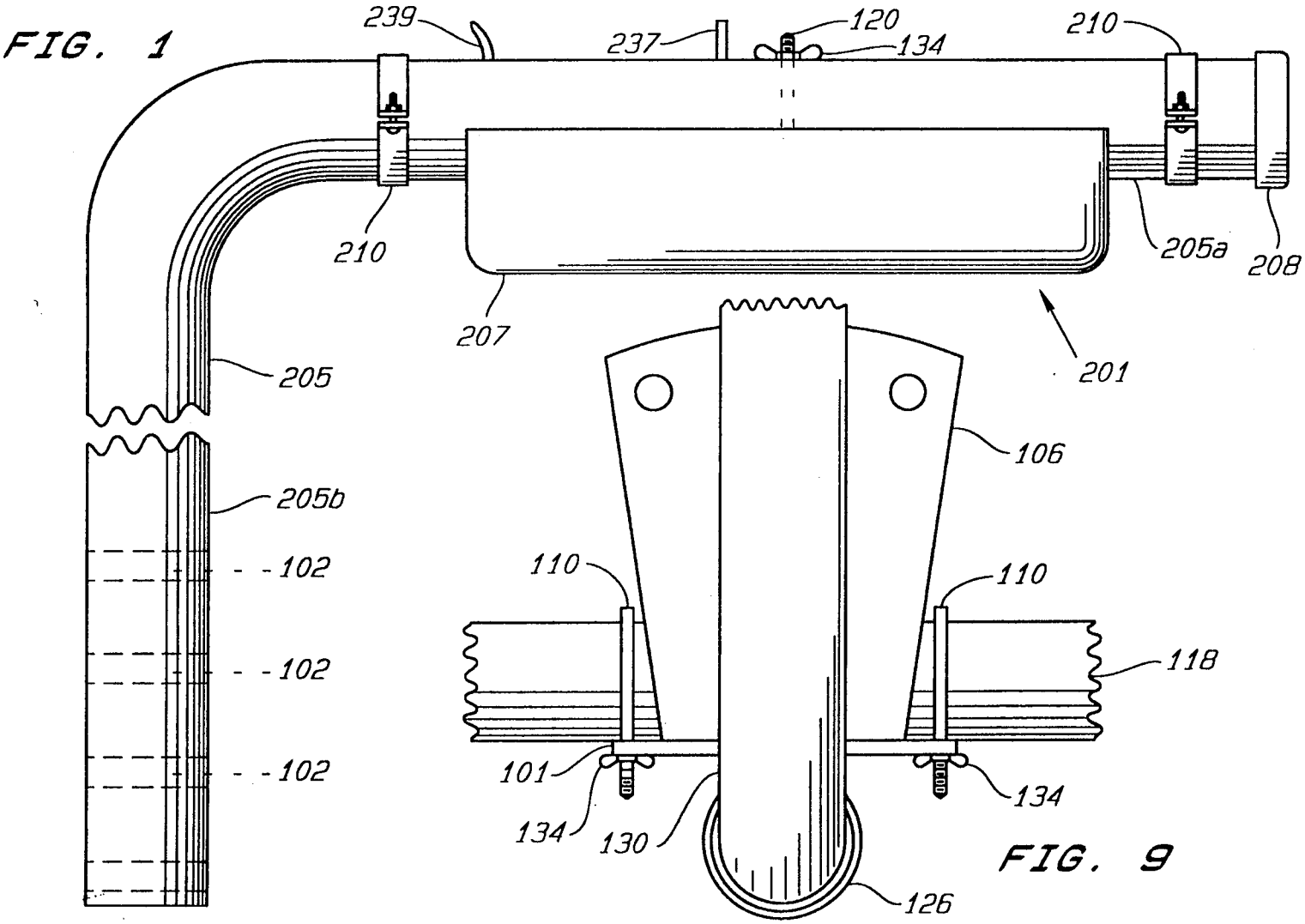
FIG. 1 is a fragmentary elevational view, showing the upper foot support portion of the invention and its support bracket broken away.
FIG. 9 is a fragmentary elevational view of the support bracket, base plate assembly and bed rail as would be seen looking from the left hand side of FIG. 2.

The base assembly 100, as seen in FIG. 2, comprises a base plate 101 extending horizontally under the bed from one side and a vertical cam plate 106 integral with and extending upwardly from one end of the plate 101 outside of the bed rail 118. The base plate 101 is clamped to the inside of the bed rail by a sliding inside rail clamp 108 which is secured to the base plate by a bolt 120 extending through the slot 119 in the clamp 108 (see FIG. 6) and through an aperture in the base plate. The bolt is secured by a wing nut 134. A pair of outside rail clamps 110 extend through holes located in the base plate 101 on opposite sides of the vertical cam plate 106 as seen in FIG. 9. The clamps 110 each comprise a straight shank which has a threaded portion on one end and has a hook at its other end. The hooks of the outside rail clamps 110 are hooked over the top edge of the bed rail 118 while the threaded shank ends extend through and beneath the base plate 101 where they are secured by wing nuts 134. Tightening the wing nuts on the outside rail clamps 110 draws the base plate tight against the bottom of the bed rail 118.

A pair of horizontally spaced suspension rings or sleeves are supported beneath the base plate 101 by V-shaped brackets 128 welded to the bottom of the base plate (see FIG. 5) and to the suspension rings. The suspension rings 126 rotatably and slidably support the lower support bar 130 of the U-shaped suspension bracket assembly 103.

Figure 3:
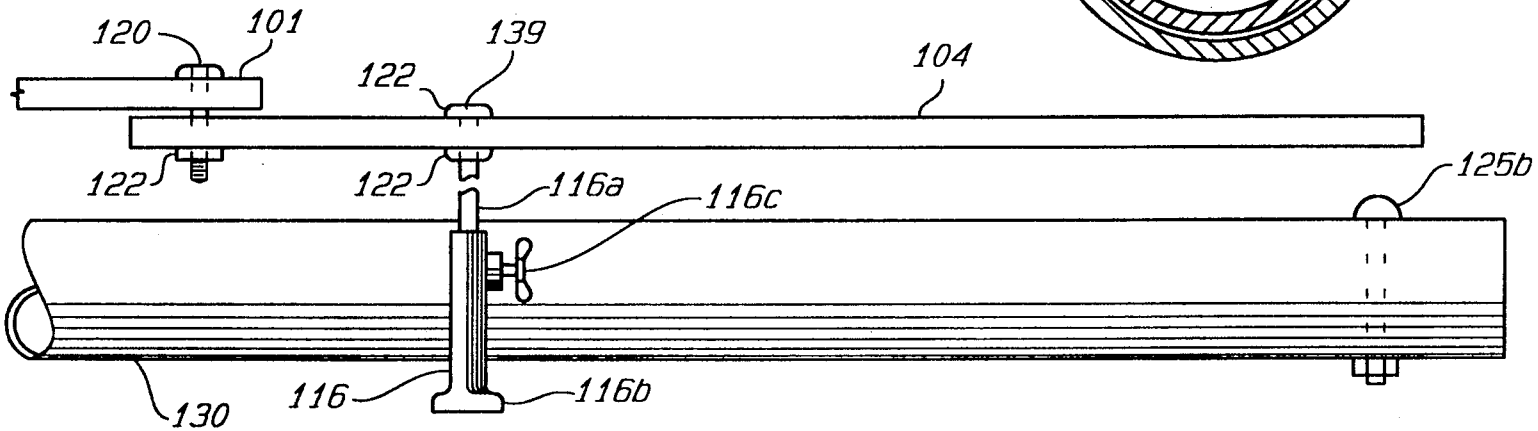
FIG. 3 is a fragmentary elevational view showing the right hand end portion of the support bracket and base plate shown partially in FIG. 2.
Figure 4:
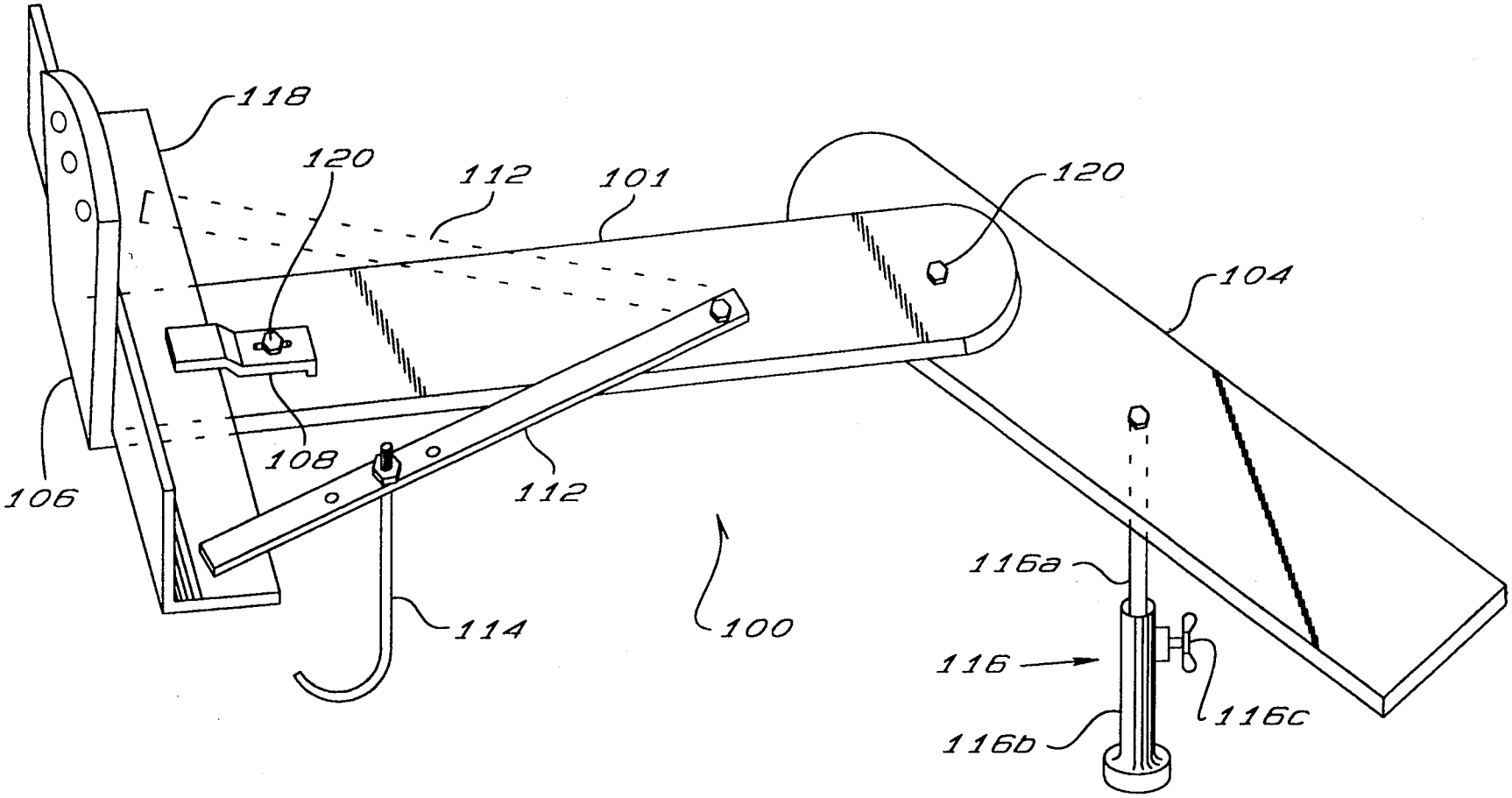
FIG. 4 is a perspective view of the base plate assembly portion of the invention clamped to a bed rail.

Referring to FIGS. 3, 4 and 17 a base support plate 104 is shown pivoted beneath the base plate 101 by a bolt 120 extended through aligned apertures in the base plate and base support plate and secured by nut 122. The base support plate 104 may be swung horizontally about the pivot bolt 120 so as to be positioned under a bed slat or other transverse bed member. A support foot 116 mounted under the base support plate 104 is adjustable in length to rest on the floor beneath support plate 104 thereby supporting the base support plate firmly underneath the bed slat or other transverse bed member. The adjustable support foot includes an upper foot support member **116*a* extending through the base support plate 104 and locked therein by a nut 122 and a hollow lower foot support member 116*b* which slidably receives the upper foot support member 116*a* therein. Once the length of the foot support member is adjusted the distance required so that the lower foot support member rests on the floor while the base support plate 104 is held up against the underside of a bed slat, a set screw 116*c* is tightened to lock the upper foot support member 116*a* in adjusted position relative to the lower foot support member 116*b***.

The U-shaped tubular suspension bracket 103, as best seen in FIG. 17, includes an upper suspension bar 205 and a lower support bar 130. The upper suspension bar 205 includes a horizontal portion **205*a* which overlies the bed B and a downwardly extending support portion 205*b* which is telescopically received within the open upper end of the tubular lower support bar 130. The lower support bar 130, as previously described, is supported under the bed beneath the base plate 101 by the bar support rings 126 attached to brackets 128. The support portion 205*b* of the suspension bar 205 is provided with a plurality of adjustment holes 102 through one of which a bolt 120, extending through a hole in the upper end portion of the lower support bar, may be selectively passed to adjust the height of the suspension bar 205** relative to the bed B.

The U-shaped suspension bracket 103, as previously stated, is capable of sliding and rotating within the support rings 126. Referring to FIG. 17, the bracket 103 may be pulled outwardly of the side of the bed B until the stop bolt 125 in the right hand end of the lower support bar engages the innermost suspension ring 126. Inward sliding movement is limited by engagement of the upstanding portion of the bracket 103 with the side of the bed.

The bracket 103 is normally locked in a selected fixed position by means of a position lock assembly shown generally by the arrow 132 in FIG. 2. The lock assembly 132 includes a channel-shaped lock assembly base 140 welded to the side of the lower support bar 130 adjacent to its upper end, a spacer member 141 welded or otherwise secured on base member 140, a lock lever 136 pivotally mounted on the lock assembly base 140 and spacer 141 by a bolt 120 extending through the channel-shaped base 140, spacer 141 and lock lever 136

(FIG. 7). A nut 121 and pressure washer 142 on the end of bolt 120 secure the lock lever 136 on the end of the pivot bolt. Looking again at FIG. 2, it is seen that the spacer member 141 overlies the cam plate 106 so that the lock lever 136 is free to swing on bolt 120 relative to the inside face of the cam plate 106. The cam plate 106 has three holes 143, 144 and 145 located so that their centers are radially equidistant from a center of rotation of the lower support bar 130 in sleeves 126. The hole 143 is a center hole with the holes 144 and 145 being equidistant from the center hole 143. A stud 138 is provided to extend through the channel base member 140 and the cam plate 106 and to project beyond the cam plate 106 into the path of the lock lever 136. The stud 138 is welded or otherwise secured to the inside of the channel base member 140. The stud is adapted to be selectively engaged in one of the holes 143, 144 and 145. This is accomplished by pulling the U-shaped bracket 103 outwardly away from the side of the bed to disengage the stud 138 from one of the holes, rotating the bracket 103 to a position where the stud is aligned with another of the holes 143, 144, 145, and pushing the bracket 103 in to engage the stud in a selected hole 143, 144 and 145. The lock lever 136 is biased to hang downward from its pivot bolt 120 in front of the cam plate as seen in FIGS. 2 and 8. With the stud in a selected hole and the lock lever hanging down as seen in FIG. 8, the bracket 103 cannot be pulled outwardly because the lock lever will prevent outward movement. When it is desired to move the position of the bracket 103, a person can engage the lock lever by its finger piece 136*a* and rotate the lock lever away from the stud 138 until it lies above the cam plate. With the lock lever entirely above the cam plate 106, the bracket 103 can be pulled out away from the bed side to disengage the stud 138 from a hole 143, 144 and 145, and rotated to another selected position.

Looking at FIGS. 15*a*, 15*b* and 15*c* different positions of the bracket 103 are seen. The capability of moving the bracket 103 to the right or left of center enables the adjustment of the foot support assembly relative to the end of the bed.

For a bed with a footboard as seen in FIG. 15*a* the exercising device can be located at a desired distance from the footboard along the rail 118. The vertical or central position of the bracket 103 relative to cam plate 106 can be used so that the foot support assembly is located above and adjacent to the end of the bed. The dotted lines above the solid line depicting the bracket 103 and foot bar assembly 200, show how the suspension bar 205 can be adjusted to different heights by telescoping the suspension bar 205 relative to the lower support bar 130.

FIGS. 15*b* and 15*c* show the exercising device 10 mounted on a hollywood style bed which has legs supporting the bed frame under the bed. The exercising device is seen clamped to the bed rail 118 forward of the rear leg L. In order to have the foot bar close to the end of the bed, the bracket 103 is adjusted to the left of vertical. FIG. 15*c* is similar to FIG. 15*b* but shows the exercising device mounted on the opposite side of the bed from the position shown in FIG. 15*b*.

The arcuate dotted lines 146 shown in FIGS. 15*a*, 15*b* and 15*c* show how the bracket 103 can be swung down to a horizontal position depicted by the dotted line 147 where the suspension arm 205 with the footbar assembly 200 and instep support assembly 201 can be stored in non use position under the bed. This can be accomplished by moving the lock lever 136 to a position where it won't engage the cam plate 106 when the bracket is pulled out from the side of the bed, pulling the bracket 103 all of the way out until the suspension bar 205 no longer overlies the bed, swinging the bracket 103 downward to the horizontal position 147 and then pushing the bracket 103 in toward the side of the bed until the suspension arm 205, footbar assembly 200 and instep support assembly 201 are positioned under the bed.

To support the U-shaped bracket 103 and its attachments in a substantially horizontal position under the bed B a bracket arm 112 (see FIG. 4) is attached to the base plate 101 by a bolt 120 and nut (not seen). The other end of the bracket arm 112 rests on the rail 118. A hanging hook 114 having a straight shank with a threaded end is adjustably mounted to hang beneath the bed by inserting the threaded shank end through one of three longitudinally spaced holes located in the bracket arm 112 and securing the hanging hook to the bracket arm by two nuts, one at the top and one under the bracket arm. The hook 114 is shaped to hold the lower support arm 130 and suspension arm 205 when they are swung down and pushed under the bed. The bracket arm 112 must always be on the side of the base plate 101 toward the head of the bed.

HOW THE INVENTION IS MADE

In constructing the U-shaped bracket 103 comprised of the L-shaped lower support bar 130 and the L-shaped suspension bar 205, and the support bar rings 126, three different sizes of pipe, or tubes, are needed. It is best to select the sizes beginning first with the smallest size which will be used for the suspension bar 205 (FIG. 1). The pipe 205 must be of a size sufficient to support the lever stress exerted when the device is in use. The pipe for the lower support bar 130 must be of a size larger than the pipe 205 so that the lower end 205*b* of pipe 205 telescopes freely in the open upper end of the lower support bar 130. The lower support bar suspension rings 126 must be of a larger size to receive the lower support bar 130 therein. The pipes 205, 130 and 126 should be close fitting but allowing free movement.

FIG. 4 shows a top perspective view of the parts comprising the base assembly 100. Starting with the base plate 101, cut this plate not less than 127 mm wide by 406.4 mm [16"] long. The right end of plate 101 can be oval cut, the left end is cut square. Next bore a hole at each corner of the left end of plate 101 at 6.350 mm [¼"] from each edge (see FIG. 9). Next bore three holes on a center line 12.7 mm [½"] apart beginning 50.8 mm [2"] from left end of plate 101. Bore one hole on the center line 254 mm [10"] from the left end and one hole at the right end on center line 63.5 mm [2½"] from the right end of plate 101. All of these holes are 6.35 mm [¼"] except the one at the right end which should be not less than 9.525 mm [⅜"] dia. Bore 6.35 mm [¼"] holes on each side of plate 101 at 25.4 mm [1"] from left end and 12.7 mm [½"] from sides of plate 101. These holes are for screws used to attach the base assembly 100 to the frame of a box spring 500 when the device is used on beds with no railings. The first two holes from left to right are for clamps 110, the next two holes are for attachment to box spring 500, the next group of three holes are for clamp 108, the next hole is for bracket arm 112 and the next hole at far right is for base support plate 104, all explained herein later.

Next cut the cam plate 106. This should be 254 mm [10"] high 76.2 mm [3"] wide at bottom and 127 mm [5"] wide at top. To get the proper radius across the top of cam plate 106 draw a line 381 mm [15"] on a flat wood surface, then drive a nail on the line at left end. Mark the line at a point 355.6 mm [14"] from the nail. Now place the plate 106 on this line with the top edge centered on the line and at the point of the mark on the line with the bottom of the plate also centered on the line. Tie a string around the nail and hold a pencil to the string at the top center edge of plate 106, mark left and right across plate 106 to form a radius cutting line. Saw on this line and sand smooth. Do not bore hole yet as shown in FIG. 9. This will be cone later. Next the cam plate 106 is welded to the left square end of base plate 101 with its small end down and centered on base plate 101 as shown in FIG. 9. Now weld the brackets 128 and rings 126 onto bottom side of base plate 101. Now the support bar 130 is bent as in FIG. 2 so that it extends upwardly about 381 mm [15"] and at a right angle with the horizontal portion twice the distance that the suspension bar 205 extends over the bed. A hole 102 is bored through the top end of the lower support bar (FIG. 2) parallel to the long bottom portion of the lower support bar.

FIGS. 2, 7 and 8 show detail features of the position locking assembly 132. In making the position locking assembly a base plate 140 is cut from a metal channel bar and a build up plate, or spacer, 141 is welded to the base plate 140. Holes are bored through members 140 and 141 for the reception of bolt 120 and through the base plate 140 below the holes for bolt 120 for reception of the stud 138. Bolt 120 is placed through the holes in channel 140 and in spacer 141 from inside of the channel 140 so that its threaded end extends outwardly beyond the spacer 141 and its head is welded to the inside of the channel (see FIG. 7). The stud 138 is also placed through the hole in the channel 140 from inside of the channel so that its end projects outwardly beyond the channel 140 (FIG. 2). The head of stud 130 is welded in a fixed position to the inside of the channel 140. A hole is bored through the lock lever 136 so that the lock lever can be pivotally mounted on the end of bolt 120 extending outwardly from spacer 141.

Insert the lower support bar 130 through the bar support rings 126 and position as shown in FIG. 2. Clamp the position locking assembly 132 to bar 130 in a position as seen in FIG. 2 with the bottom of spacer 141 above and clear of the top of cam plate 106. Now holding stud 138 against cam plate 106 swing bar 130 across cam plate 106 so that the end of stud 138 forms an arcuate line on the surface of cam plate 106. Now bore three holes the same size as stud 138 through the plate 106, one at the center of the arcuate line and one on each side of the center hole, 9.525 mm [⅜"] from each edge as shown in FIG. 8. Install the lock lever 136 on the end of bolt 120 and secure it in place with pressure washer 142 and lock nut 121. The lock assembly 132 can now be welded to the upright portion of the lower support bar 130 in the position indicated in FIG. 2. Make sure that the stud 138 works freely through the holes 143, 144 and 145 as the lower support bar is swung relative to the cam plate 106 and that the bottom of spacer 141 clears the top of the cam plate 106. Any slack between bar 130 and the support rings 126 should be taken up and the lock assembly 132 should be locked in position before welding.

The outside rail clamps 110 are placed over bed rail 118 and through the holes in the corners of base plate 101 (FIG. 9) and are secured in position with wing nuts 134.

Figure 6:
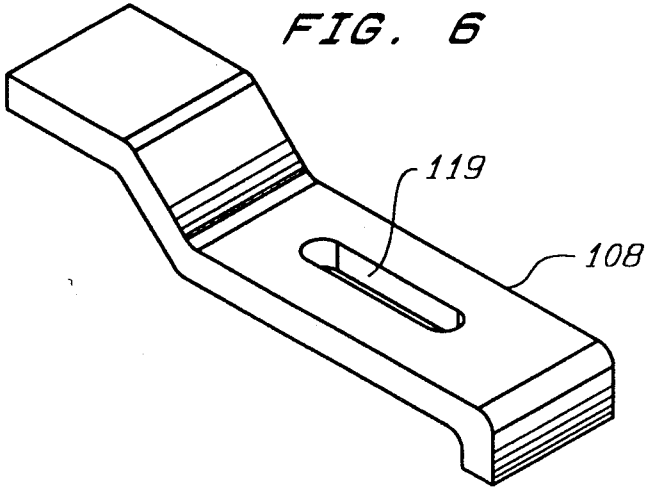
FIG. 6 is a perspective view of the inside rail clamp seen in elevation in FIG. 2.

FIG. 6 shows the inside rail clamp 108. This clamp fits on top of the base plate 101 (FIG. 2) and is retained by a bolt 120 and wing nut 134. It has a two fold duty in that is braces against the rail 118 and at the same time it presses down against the rail to hold the base plate 101 firmly against the bottom of rail 118. The holes 102 along the center of base plate 101 and the slot 119 in the clamp 108 allow for adjustment of the clamp 108 and base plate assembly 100 to different size rails 118 for different beds.

FIGS. 3 and 4 show base support plate 104 (best shown in FIG. 4). This plate should be not less than 76.2 mm [3"] wide and 406.4 mm [16"] long and of the same thickness as the base plate 101. It is secured to base plate 101 by a bolt 120 and nut (not shown).

The adjustable support foot 116 is made from a section of rod **116*a* telescoping into a section of pipe 116*b* having a foot plate welded thereon and a clamp 116*c* at its mid section. The rod 116*a* should be not less than 12.7 mm [½"] in diameter and threaded at its top end so that it can be secured to base support plate 104 by two nuts, one under and one above the plate 104**.

At the far right end of the lower support bar 130 a hole is bored and a stop bolt 125 is secured therein by a nut **125*b***.

FIGS. 1, 10 and 16 show suspension bar 205, foot bar assembly 200 and instep support assembly 201 as well as other components of the invention.

The suspension bar is bent at right angle so that is extends approximately 457.2 mm [18"] at one end and 609.6 mm [24"] at the other end. At a position approximately half way of the longer end, bore six holes the same size as the hole at top of lower support bar 130 (FIG. 2). These holes and the hole and bolt at the top of lower support bar provide adjustment to allow for different thickness of box springs and mattresses. The holes must be bored in parallel alignment with the horizontal part **205*a* of the bar 205**.

The foot bar assembly 200 as seen in FIG. 10 is formed using a U-shaped bar 216, two short L-shaped bars 210 and two bands 211. The bands are formed with lips 209 (FIG. 13) and have holes bored through the lips for bolts 120. Nuts 134 are threaded on bolts 120 for securing the bands 211 around the suspension bar 205. The L-shaped bars 210 are welded at 99 to the bands 211. Three holes are bored through each these bars and two holes through the ends of bar 216. Four bolts through the holes in opposite ends of foot brace bar 216 and selected holes in bars 210 are used to make adjustments for feet. Comfort padding 206 is attached to the foot brace bar 216 with two bolts counter sunk into tack block 233 as seen in FIG. 11 and secured with nuts 122.

The instep support assembly 201 is constructed as shown in FIG. 12. The tack block 233 is shaped so that when it is drawn tight to suspension bar 205 it braces on both sides and is held snugly by bolt 120 and wing nut 134. Three holes are drilled through suspension bar 205, one straight through and one on each side at an angle of about 15 degrees so that when suspension bar 205 is moved to right or left the unit will hang parallel with the top of the bed. These holes are positioned slightly to the right of center so that the cord ring 237 can be positioned at the center of the assembly allowing for equal leverage when one is pulling on grip cord 238.

The grip cord 238 is passed through cord ring 237 over to and around cord wrap bracket 239 and then tied around same, this allows for adjustment to different length persons.

The cord ring 237 and cord wrap bracket 239 are welded at 99 to the top of suspension bar 205.

A cap 208 is placed over the end of suspension bar 205 for safety.

FIG. 14 shows the grip cord unit 238. It is constructed of a wooden handle and a rope cord 236. A groove is cut around the center of the wooden handle and the cord 236 is secured arount it. The other end of cord 236 is matted.

OPERATION

The base plate 101 and cam plate 106 is a single welded unit, to this is added the two brackets 128 and support bar sleeves 126 by welding as shown in FIG. 2. The base support plate 104 is mounted to base plate 101 by a bolt 120 and nut 122. The adjustable support foot 116 is attached midway of base support plate 104 by a threaded rod end and nuts. The function of the support foot 116 is to brace the base unit against the bottom frame of the box spring 500 or against a slat. It is mounted adjustably so that it can move left or right as needed to find support.

The bracket arm 112 and hook 114 are situated so that they serve to support bars 205 and 130 when the unit is folded under a bed. The bracket 112 must always be on the side of the base toward the head of bed.

The unit is attached to the under side of a bed by clamps or screws as stated in the description.

The cam plate 106 has three holes for adjustment of the unit when used on different sides of beds or on different types of beds. When the device is used on a bed where the rail 118 is supported by headboard and footboard the stud 138 is placed in the center hole 143. When used on a bed having rails without a footboard the stud is placed in the hole toward the foot of the bed (FIGS. 15*a*, 15*b* and 15*c*). When the proper hole is selected the unit is locked in position by lock lever 136 (FIGS. 2, 7 and 8).

Holes are provided through the top of lower support bar 130 and through the bottom portion 205*b* of suspension bar 205 which allow for adjustment of the suspension bar 205 up or down. When the right position is found the units are held in that position by a bolt 120 at the top of the lower support bar 130. The foot brace bar 216 is held in adjusted position by tightening wing nuts 134 on bolts 120 through lips 209 on bands 211 fitting around suspension bar 205. The instep support pad 217 is adjusted by placing bolt 120 (FIG. 12) through one of three holes in suspension bar 205 and is secured with nut 134. A safety cap 208 is placed on the end of suspension bar 205.

The cord 236 is passed through cord ring 237 over to and around cord wrap bracket 239. When the proper adjustment is found, the cord 236 is tied around itself to hold cord handle 238 in place.

The comfort padding 206 is preferably of foam rubber. Cover 207 is upholstery fabric. The instep pad 217 and the pad on bar 216 are made in the usual manner of upholstering. Padding 206 is placed over block 233 and fabric 207 is secured over padding 206. The fabric 207 is held in place by a line of tacks on the back of block 233 centered to that they are hid by bar 205 and bar 216 when mounted.

When using the device a person will lie in bed face up with both feet braced against the foot bar 200. The instep pad is now resting on the instep of the feet. The cord 236 being adjusted so that there is no slack in the cord when the cord handle 238 is held in the hands with both arms stretched out. The person exercises by either using the back and hip muscles or by using the arm and hand muscles, or both in combination, thus making it easier for a beginner, an elderly person, or an over weight person to use.

Accordingly, it will be seen that the exercising device of the invention provides a highly reliable, light weight, yet economical device which can be used by persons of almost any age or weight. All of the objects have been accomplished. My invention has many advantages over the prior art in that it can be used on almost any bed, it can be upholstered with any desired fabric and changed when desired, it can be folded out of sight under the bed using no tools and without lifting, it does not interfere with changing bed linen, it is economical to produce, and it requires no costly tooling to produce.

The invention allows hands and arms to be used in combination with hip and back muscles in order to do sit-up exercising or one can use one group of muscles without the help of the other group. For instance, sit-ups may be done without the cord 236 or pull-ups may be done without the help of the back muscles. Also, the invention can be used under the bed covering, and can be left there out of sight when not in use.

Although the description above contains many detailed specifications, these should not be construed as limiting the scope of the invention but as merely providing illustrations of some of the presently preferred embodiments of the invention.

Figures 18, 19A, 19B, 20, 21:
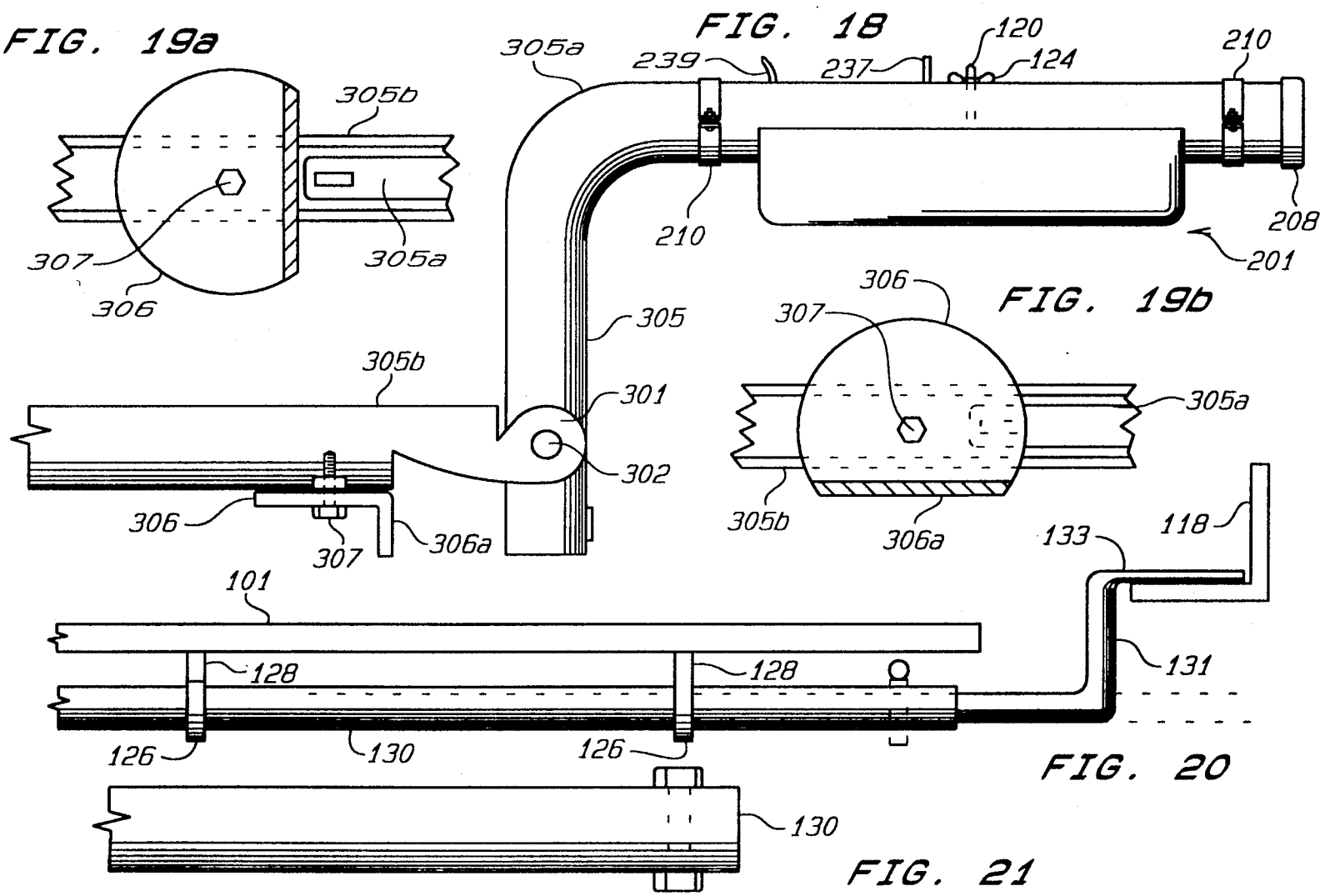
FIG. 18 is a fragmentary elevational view of a modified suspension arm of the invention.
FIG. 19*a* is a bottom view of the hinge portion of the suspension arm of FIG. 18 showing the hinge latch in the unlatched position.
FIG. 19*b* is a bottom view similar to FIG. 19*a* but showing the hinge latch in the latched position.
FIG. 20 is an elevational view of a modified lower support bar for the invention.
FIG. 21 is an elevational view of a portion of the lower support bar.

Modifications of the invention shown and described in conjunction with FIGS. 1–17 may be used. For example, FIG. 18 shows a modified suspension bar 305 which includes upper and lower suspension bar members 305*a* and 305*b* respectively connected by a hinge consisting of a pair of spaced hinge ear members 301 pivotally mounted on opposite sides of the upper suspension bar element 305*a* by a pivot pin 302 extending through the hinge members 301 and the lower end of the suspension bar element 305*a*. A latch 306 is provided to lock the lower portion of the upper suspension bar member 305*a* in alignment with the hinged end of 305*b*. The latch element 306 is mounted for turning motion adjacent the end of 305*b* by a pivot bolt 307. The end of 305*b* is cut away on one side so that the lower end of 305*b* beyond hinge pin 302 will seat in the remaining channel-shaped end portion of 305*b* when the lower end of 305*a* is brought into axial alignment with the member 305*b*.

FIG. 19*a* shows the lower end of 305*a* seated in the channel-shaped cutaway end of 305*b* with the latch member 306 in unlatched position. FIG. 19*b* is similar to FIG. 19*a*, however, it shows the latch member 306 in latched position so that the lower end of 305*a* is in rigid axial alignment with 305*b*. The structure shown in FIGS. 18, 19*a* and 19*b* would be useful in situations where there is limited space along the bedside.

FIGS. 20 and 21 show a modification of the base plate 101 and lower support bar 130 shown in FIGS. 3 and 4. The modification eliminates the use of the base support plate 104 and of the adjustable support foot 116. The base plate 101 would be clamped to the bed rail 118 in the manner shown in FIG. 4, however, instead of using the stabilizing base support plate 104, a separate tubular extension 131 is telescoped in the end of the lower support bar 130. The extension 131 has a flattened upwardly offset end 133 which is adapted to seat on the bed rail 118 on the opposite side of the bed from the rail to which the base plate assembly 100 is clamped. By having the extension 131 telescoped in the end of the lower support bar the distance to which the extension 131 can be extended can be varied for different size beds.

The exercising device of this invention could be constructed on a roll-under or slide-under bed foundation.

Various materials including steel, aluminum, wood, plastic or a combination thereof can be used in the construction of the invention. Some of the components could have shapes other than the shapes shown, such a square, channel angle, flat, etc.

Another embodiment could be a structure in which the foot accommodating units are suspended over the bed, one on each side of the bed and supported by a U-shaped bar or bracket, which would be fastened adjustably to each bed rail or box spring frame. The U-shaped bar would be adjustable so that it could be swung down over the foot of the bed.

Another embodiment could be an attachment comprising a structure in which the feet accommodating unit would be suspended from an L-shaped bar, one end being inserted into the end of suspension bar 205 and the other end being attached to the bed railing or box spring at the other side of the bed, thus making the device a double fixture.

Thus the scope of the invention should be determined by the appended claims and their legal equivalents, rather than by the examples given.

I claim:

1. An exercise device for exercising in bed comprising a rigid base with clamp means for attaching the base to the side of a bed;

a telescoping U-shaped suspension member which is rotatably and slidably attached at one end thereof to the base, and which extends upwardly over the bed during use;

user support means mounted on the other end of said suspension member;

said U-shaped suspension member being rotatable from a nonuse storage position under the bed to a use position over the bed.

2. The exercise device of claim 1 wherein said base includes means for supporting said U-shaped suspension member in selected upright positions, one being a central upright position, and at least two other positions, one on each side of said central upright position.

3. The exercise device of claim 2 together with latching means for latching said U-shaped suspension member in a selected upright position.

4. The exercise device of claim 1 together with means for supporting said U-shaped suspension member in an upright use position over the bed and means for supporting said U-shaped suspension member in a nonuse position under the bed.

5. The exercise device of claim 1 wherein said telescoping U-shaped suspension member comprises first and second L-shaped members, the first one of said L-shaped members including a suspension bar for extending over the bed in the use position and a right angle leg portion extending downwardly from said suspension bar in the use position, the second L-shaped member including a straight portion which is rotatably and slidably attached to said base portion and a right angle leg portion which telescopes with respect to the right angle leg portion of said first L-shaped member and means for adjusting the telescoping leg portions in selected positions for varying the distance between the suspension bar of said first L-shaped member and the base attached straight portion of said second L-shaped member.

6. The exercise device of claim 5 wherein said L-shaped members are rigid tubes, one L-shaped member being of larger diameter than the other, so that the leg of the larger diameter L-shaped member telescopically receives the leg of the smaller diameter L-shaped member.

7. The exercise device of claim 5 having an instep comfort pad attached to said suspension bar for engagement with the foot insteps of a person using the exercise device, and a foot support spaced from and substantially parallel to said suspension bar with adjustable attachment means for attaching said foot support at a selected distance from said suspension bar and at a selected angular position of rotation about the axis of said suspension bar.

8. The exercise device of claim 7 wherein said foot support includes comfort padding thereon.

9. The exercise device of claim 8 wherein the instep comfort pad and the padding on said foot support are covered with changeable upholstery material.

10. The exercise device of claim 1 wherein said user support means mounted on said suspension member includes a pull cord and handle, and attachment means on said suspension member to which said pull cord is attached including means for varying the length of the pull cord extending from said suspension member whereby a person using the exercise device while lying in bed can use the pull cord for pulling up from a prone position.

11. The exercise device of claim 10 wherein said user support means further includes means for supporting the feet of the user.

* * * * *